United States Patent [19]

Maso

[11] Patent Number: 4,895,262

[45] Date of Patent: Jan. 23, 1990

[54] OVERTURNING-PREVENTING DEVICE FOR CRANE TRUCKS AND SIMILAR MACHINES

[75] Inventor: Roberto Maso, Calendasco, Italy

[73] Assignee: Valla S.p.A., Milan, Italy

[21] Appl. No.: 281,547

[22] Filed: Dec. 8, 1988

[30] Foreign Application Priority Data

Feb. 16, 1988 [IT] Italy ..... 19418 A/88

[51] Int. Cl.[4] ..... B66C 13/50

[52] U.S. Cl. ..... 212/154

[58] Field of Search ..... 212/154; 414/701

[56] References Cited

U.S. PATENT DOCUMENTS

| | | | |
|---|---|---|---|
| 3,612,294 | 10/1971 | Wilkinson | 212/154 |
| 3,680,714 | 8/1972 | Holmes | 212/154 |
| 4,687,406 | 8/1987 | Kinsey | 212/154 |

*Primary Examiner*—Kenneth R. Rice

*Attorney, Agent, or Firm*—Foley & Lardner, Schwartz, Jeffery, Schwaab, Mack, Blumenthal & Evans

[57] ABSTRACT

The overturning-preventing device (1) for crane trucks (3) and similar machines is associated with the self-propelled truck (6) of the crane truck (3) in correspondence of the rear axle (8) of the same car, and is substantially composed by a pair of plate means (20, 21) hinged to each other (22) in correspondence of one of their edges. The necessary force in order to generate the rotation of the plate means (20, 21) relatively to each other is adjustable by means of suitable adjustment means (28, 28A) which influence the minimum load transmitted by the rear axle (8) to the ground. In case the overturning torque is large, the rear portion of the self-propelled truck (6) tends to lift, while the rear axle (8), thanks to its own weight, tends to remain stably resting on the ground, causing the plate means (20, 21) of the overturning-preventing device (1) to divaricate. Such a divarication is used as a signal for enabling a circuit commanding the load-lifting operations by the crane truck (3) to be discontinued. The overturning-preventing device (1) is also suitable for application to single-wheel-rear-axle crane trucks, with said rear axle being either of heavy or of light type, as well as to lift trucks.

13 Claims, 4 Drawing Sheets

OVERTURNING-PREVENTING DEVICE FOR CRANE TRUCKS AND SIMILAR MACHINES

The present invention relates to an overturning preventing device for crane trucks and similar machines, such as lift trucks, graders, and still other machines formed by a self-propelled truck supporting operating means, with said truck comprising a rear axle, the wheels of which are linked to each other by means of an axle constrained to the truck by means of vertical elements.

The overturning risk is constantly present during the operating steps of working machines, and, in particular, of the crane trucks.

It is known that an overturning occurs when the overturning torque, which causes it, exceeds determined threshold values which are a function of the structure, and of the weight of the crane truck.

Mechanical overturning-preventing devices are known, which substantially provide for the crane truck-driving operator to verify, moment by moment, the load condition, on the basis of a suitable table which reports the maximum allowed values of lifted load as a function of the range reached by the crane.

Unfortunately, such devices are affected by the shortcoming that they are only indicative of the approaching of the danger condition, in that not always the value of the lifted load can be exactly evaluated.

In such cases, in order that a reasonable safety can be achieved, it is essential that the operator has matured a meaningful experience both in estimating the weight of the loads to be lifted, and in the use of the specific machine he is controlling and that he, on the basis of said experience is also capable of perceiving the danger premonitory signals, which are typical for that particular crane truck type.

Other devices, developed at a later time, are those of electronic type.

Such devices, which are particularly complex, expensive and delicate, are based on the principle consisting in monitoring, by means of sensors installed at one or more suitably selected points on the crane truck structure, the value of the mechanical stresses generated by the lifted load, so as to be able to determine, at any time, the value of the overturning torque generated by the same load.

The signals detected by the one or more sensors are processed by an on-board computer, which compares the value of the overturning torque generated by the lifted load, to the maximum allowed torque value for that crane truck.

In case the value of the overturning torque becomes too similar to the value of the maximum allowed torque, the electronic device signals the danger condition, and stops the operation of the crane truck.

The electronic devices, besides being (as already said) complex, delicate, and consequently expensive, are affected by the serious drawback that they give the operators a safety feeling, which is not always justified. In fact, the operators, aware of the fact that the devices automatically interrupts, with rapidity and precision, any dangerous operations, do not take very much care in evaluating the dynamics of the lifting.

The lifting operation is carried out leaving to the electronic device only the task of supervising it, and of interrupting it in the event it becomes dangerous.

But in case the device, owing to a large number of reasons, does not operate, or is affected by operating anomalies, the accident is practically immediate, unavoidable, and, most times, also with fatal consequences.

Furthermore, often, both the presently used mechanical and electronic devices do not suitably exploit the lifting potential of the machine on which they are installed, due to a series of reasons, which we'll illustrate very briefly, in that they are already wellknown by those skilled in the art.

As regards the mechanical devices, such a situation is clearly purposely wished, in order to secure a safety margin which is large enough for compensating for any possible inaccuracies in load situation evaluation.

In case of electronic devices, the missed full exploitation of the power of the machine derives most times by the fact that owing to cost reasons only one type of electronic devices is manufactured, with the individual devices being then adapted, with marginal modifications, to heavy-axe crane trucks, as well as to light-axle crane trucks.

But, as well-known, inasmuch as the rear axle of the crane truck is in the opposite position relatively to the position of the lifted load, it has a major influence on the useful load the same crane truck can lift; not taking this fact into due account, is obviously to the detriment, according to cases, either of the machine (in case of a heavy-axle machine) or of the safety (in case of a light-axle machine).

The purpose of the present invention is to provide an overturning-preventing device which is capable of obviating all those shortcomings which derive from the use of the above mentioned overturning-preventing devices, without thereby giving up the relevant advantages.

Such purposes are achieved by the overturning-preventing device for crane trucks and similar machines, formed by a self-propelled truck supporting operating means, with said truck comprising a rear axle, the wheels of which are linked to each other by means of an axle constrained to the truck by means of vertical elements, characterized in that it is interposed between said vertical elements of the rear axle and the truck, and comprises: first plate means integral with the vertical elements, second plate means integral with the truck, a hinge constraining, relatively to its own axis, said first plate means and said second plate means, with said first plate means and said second plate means enabling, as the above mentioned rotation occurs, means for discontinuing the operation of the crane.

The advantages deriving from the device according to the present invention are the following:

- safety in operation, insensitiveness to the failures, simpleness and low cost of manufacturing and operations, typical for the mechanical devices;
- precision comparable to the precision of the electronic devices;
- possibility of suitably exploiting, with full safety, the maximum lifting potential offered by a whatever type of operating machine, whether it is a crane truck, or another type of machine, whether of the heavy-rear-axle or of the light-rear-axle type;
- possibility of adjusting the sensitivity of intervention of the device;
- possibility of predetermining, according to requirements, and by means of the same adjustment of the sensitivity of intervention, the minimum load to be transmitted by the axle to the ground before the device stops the operations of the crane;

possibility of applying the device to the single-wheel axles also, whether of heavy or of light type.

The invention is illustrated for merely illustrative, non-limitative purposes, in the figures of the hereto attached drawing tables, wherein.

Figure 1:
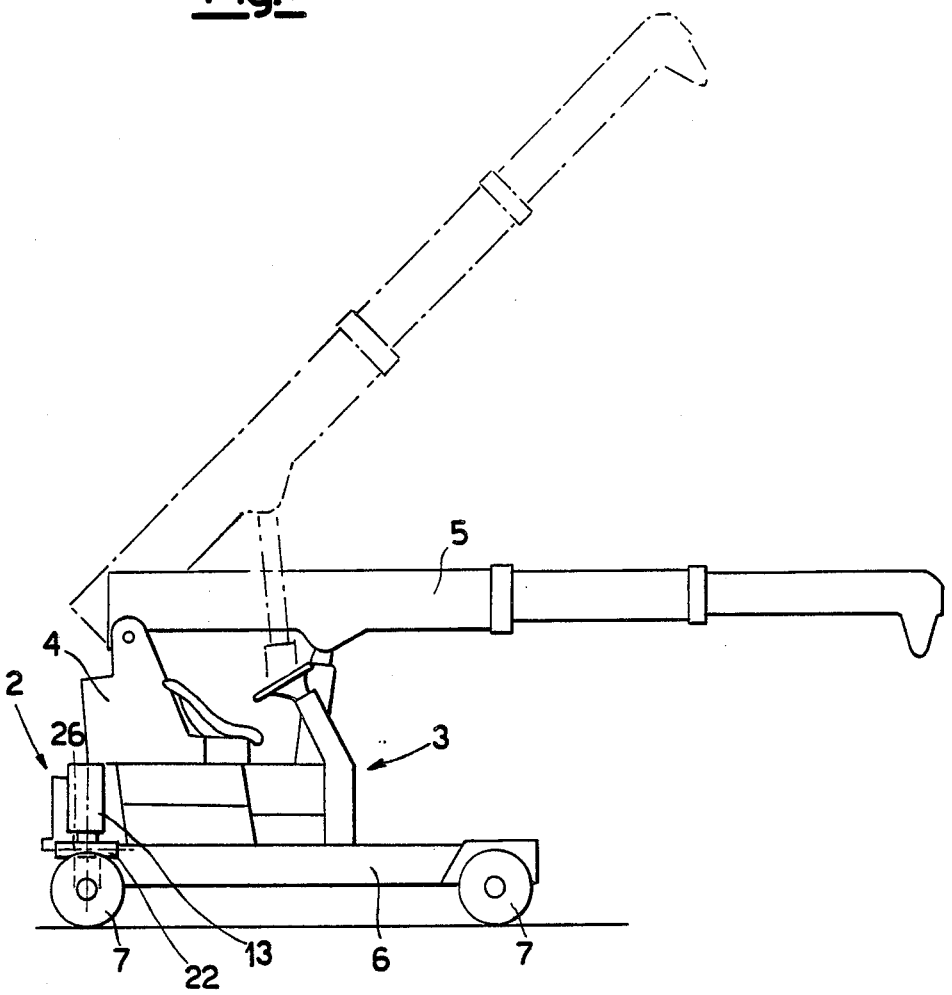
FIG. 1 shows a schematic side view of a crane truck equipped with a device according to the invention.
Figure 4:
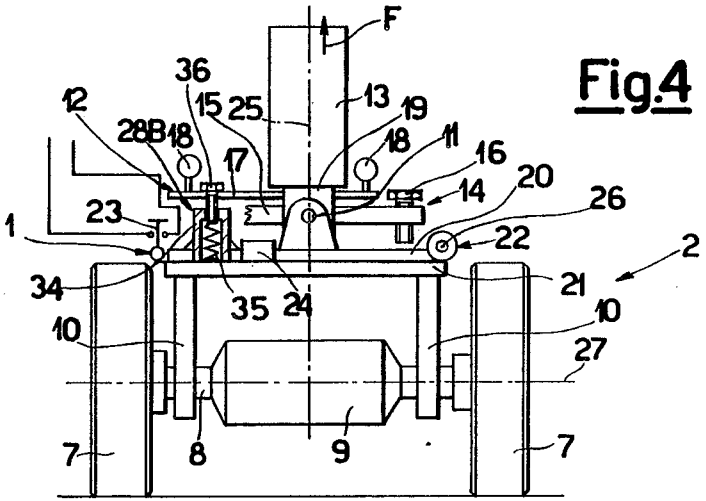
FIG. 4 shows a schematic rear view of the rear axle of a light-rear-axle crane truck, with said rear axle being equipped with an overturning-preventing device according to the invention.
Figure 5:
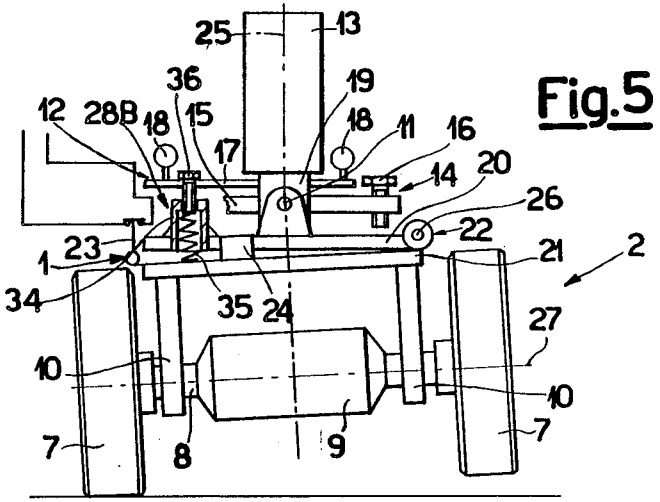
FIG. 5 shows a schematic view of the rear axle of FIG. 4, wherein the overturning-preventing device is in the condition of interruption of the lifting operation.
Figure 2:
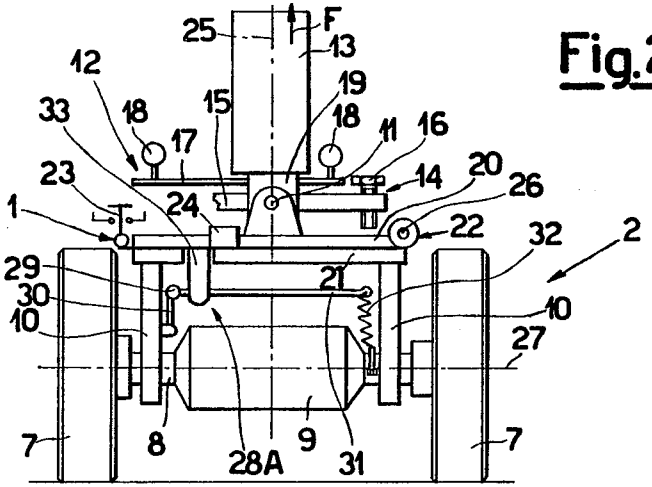
FIG. 2 shows a schematic rear view of the rear axle of a heavy-rear-axle crane truck, with said rear axle being equipped with an overturning-preventing device according to the present invention.
Figure 3:
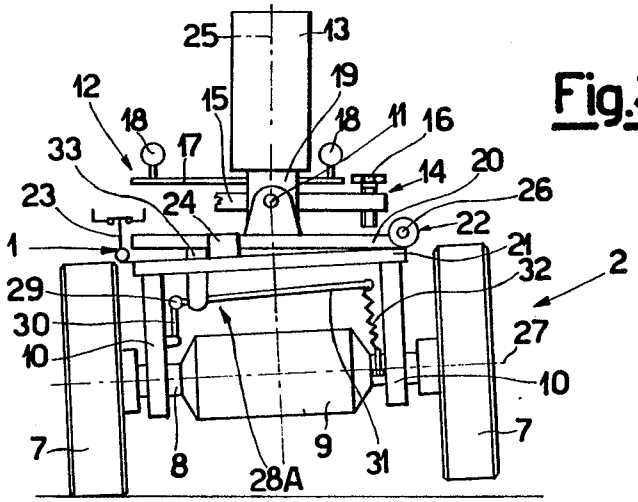
FIG. 3 shows a schematic view of the rear axle of FIG. 2, wherein the overturning-preventing device is in the condition of interruption of the lifting operation.

Referring to the above cited figures, and in particular to FIGS. 1 through 5, the overturning-preventing device, generally indicated by the reference numeral 1, is integral part of a steering, driving rear axle 2 of a crane truck 3. The crane truck 3 comprises a crane 4, with a telescopic arm 5, constituting operating means borne by a self-propelled truck 6.

The rear axle 2 comprises a wheel axle 8 with relevant wheels 7, a differential 9, a pair of vertical elements 10, the same overturning-preventing device 1, a hinge 11, with a relevant rotation-limiting device 14, a steering unit 12, and a bearing-carrier sleeve 13 directly linked to the self-propelled truck 6.

In the depicted case the vertical elements 10 are rigid, but they could be constituted as well by traditional leaf springs or spiral springs associated with shock absorbers in case the hinge 11 is replaced by a rigid link.

The rotation-limiting device 14, which limits the rotation of the hinge 11, comprises a pair of horizontal arms 15 bearing adjusting screw means 16.

The steering unit 12 is composed by at least one hydraulic cylinder 18 interposed between the self-propelled truck 6 and the rear axle 2, and acting on said rear axle through at least one lever element 17 integral with a shaft 19 protruding from the sleeve 13, and the axis of which coincides with the steering axis 25. The shaft 19 is linked through the hinge 11 to the overturning-preventing device 1.

The overturning-preventing device 1 comprises first plate means 20 and second plate means 21, linked along one of their edges by means of a hinge 22, the rotation axis 26 of which is perpendicular to the revolution axis 27 of the wheels 7.

The edges of the plates opposite to the edges engaged by the hinge 22 are connected with means for interrupting the operation of the crane 4, which are constituted by a switch 23 and a relevant electrical circuit not shown in the figures, with these latter means being enabled by the rotation of the first plate means 20 and of the second plate means 21 relatively to the hinge 22.

The rotation of the plate means 20 and 21 around the hinge 22 is limited by a bridge element 24 which, in case of need, is capable of supporting the weight of the wheel axle 8, of the wheels 7, of the vertical elements 10, and, obviously, of the second plate means 21.

The overturning-preventing device 1 operates associated with means 28A, 28B for adjusting the minimum load transmitted by the axle to the ground.

The adjustment means 28A and 28B are of two types, according to whether the axle is of light type, or of heavy type. By "light axle", an axle type is meant, the weight of which, relatively to the structure of the crane truck, does not contribute to a considerable extent to generate the couple which opposes the overturning couple. The light-axle crane trucks are generally the long-wheelbase crane trucks, which therefore counteract the overturning couple by mainly exploiting the geometric characteristics of their self-propelled truck, rather than exploiting the axle mass characteristics.

On the contrary, by "heavy axle" a type of axle is meant, the weight of which, relatively to the structure of the crane truck, contributes to a major extent to generate the torque opposing the overturning torque.

The heavy-axle crane trucks are generally characterized by their short wheel base, which gives them a high manageability, but limits their lifting potentialities.

The rotation-limiting device 28A (FIGS. 2 and 3) is particularly suitable for application to heavy axles, wherein the weight of the axle should be exploited as extensively as possible, of course within the safety limits, in order to generate the torque opposing the overturning torque, whilst the rotation-limiting device 28B (FIGS. 4 and 5) is, on the contrary, better suited for being applied to light axles, on the weight of which one should not rely in order to increase the torque opposing the overturning torque.

The device 28A comprises a fulcrum 29, integral with either one of the vertical elements 10, possibly through a connecting rod 30, a lever 31, an adjustable-pre-load spring 32 and a flange 33 interposed between the lever 31 and the first plate elements 20.

The configuration taken by the device 28A is the configuration of a third class lever, wherein the power derives from the flange 33, the resistance is constituted by the adjustable-pre-load spring 32, and the fulcrum is in 29.

On the contrary, the device 28B comprises a housing 34, positioned in correspondence of those edges of the plate means 20, 21 which are opposite to the edges associated with the hinge 22, integral with the first plate means 20, inside which a spring 35 is housed, which applies a pressure on the second plate means 21. The spring 35 operates by compression, and is pre-loaded by means of screw means 36.

During the lifting carried out by the crane 4, the overturning torque generates on the rear axle 2 a force F, vertically directed from bottom to the top, which causes the first plate means 20 to separate from the second plate means 21, due to the effect of the rotation of the same plate means around the axis 26 of the hinge 22. Such a separation enables the means which command the interruption of the operation of the crane 4, constituted by the switch 23 and the relevant circuit.

In case the force F acts on a rear axle 2 equipped with a wheel axle 8 of heavy type (FIGS. 2, 3), the load-adjustment means 28A acts, by using the weight of the wheel axle 8, in the sense of preventing the plate means 20 and 21 from separating from each other, for values of the force F, which are smaller than a certain threshold limit, which is a function of the pre-load given to the spring 32, which anyway can never be such as to allow the axle 8 to rise relatively to the ground, with the practical exclusion of the device 1.

When the intensity of the force F exceeds the threshold limit—which is a function of the pre-load given to the spring 32—, the elasticity of the same spring makes it possible the lever 31 to rotate relatively to the fulcrum 29, and the plate means 20 and 21 to consequently rotate relatively to the axis 26 of the hinge 22, with the consequent tripping of the switch 23.

In case the force F acts, on the contrary, on a rear axle 2 equipped with a wheel axle 8 of light type, the means 28B for the adjustment of the load acts in the sense of favouring the plate means 20 and 21 to separate from each other, with such a separation occurring as a function of the pre-load of the spring 35 and of the same force F; however, the pre-load given to the spring 35 can never be such as to cause the plate means 20, 21 to spontaneously separate from each other.

It is important to observe that, in order that the overturning-preventing device 1 may operate correctly, it is necessary that the rotation axis 26 of the hinge 22 is always perpendicular to the revolution axis 27 of the wheels 7, in case to such wheels a driving torque is applied.

Should it be not so, the reaction torque, deriving from the driving torque transmitted to the ground by the same wheels, would tend to disturb the correct operation of the overturning-preventing device, by turning into an additional one of those torques which act on the same device, by increasing or decreasing the level of intervention of said device, according to the direction of revolution of the same driving torque.

Figure 6:
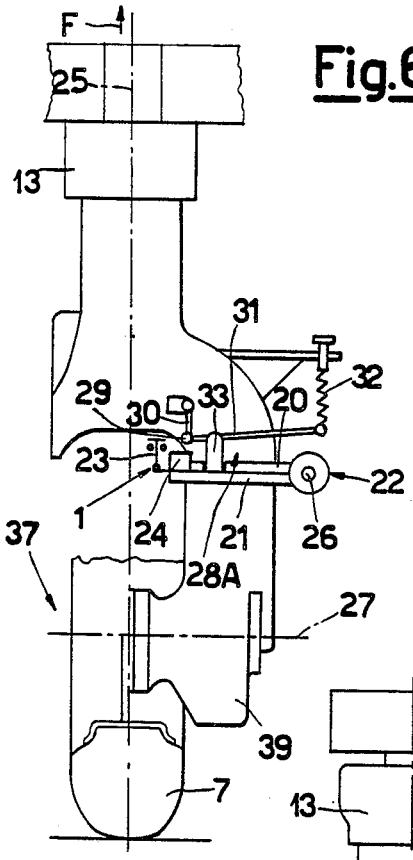
FIG. 6 shows a schematic rear view of the rear axle of a heavy-rear-axle crane truck with single-wheel rear axle, with said rear axle being equipped with an overturning-preventing device according to the invention.
Figure 7:
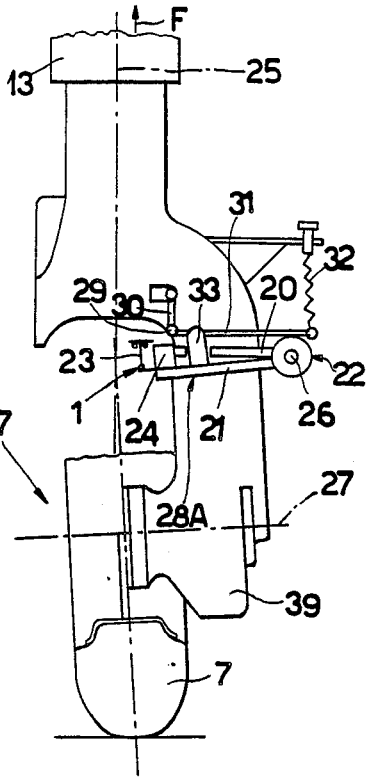
FIG. 7 shows a schematic view of the rear axle of FIG. 6, wherein the overturning-preventing device is in the condition of interruption of the lifting operation.
Figure 8:
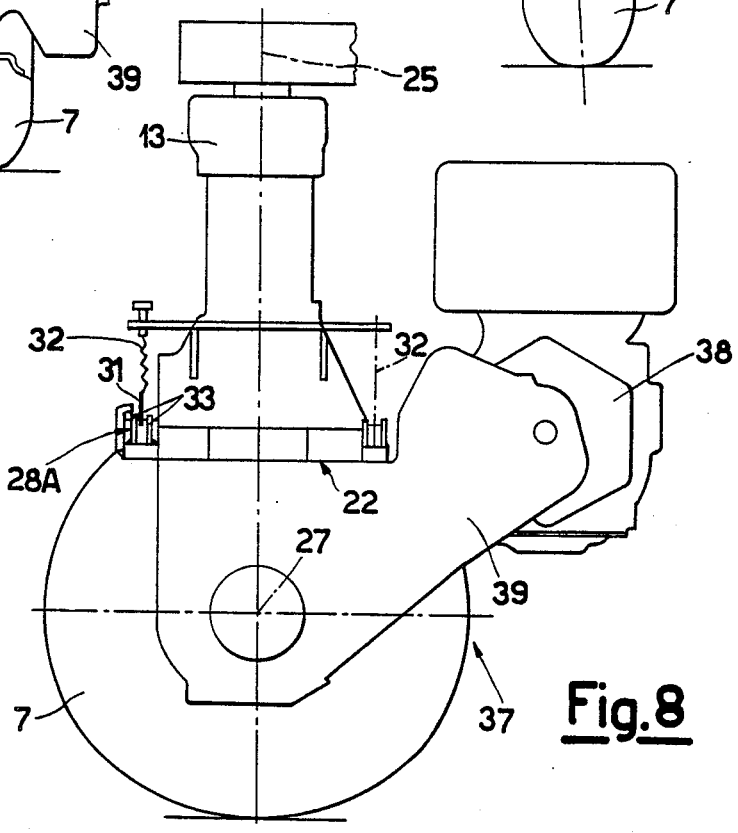
FIG. 8 shows a schematic side view of the rear axle of FIGS. 6 and 7.
Figure 9:
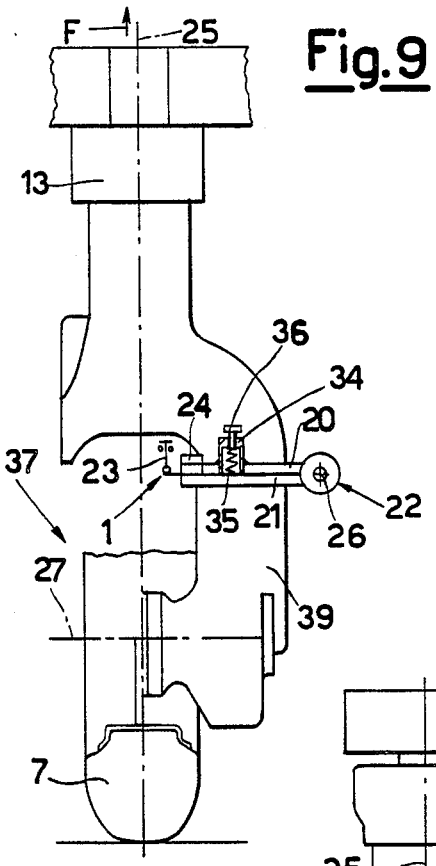
FIG. 9 shows a schematic rear view of the rear axle of a light-rear-axle crane truck with single-wheel rear axle, with said rear axle being equipped with an overturning-preventing device according to the invention.
Figure 10:
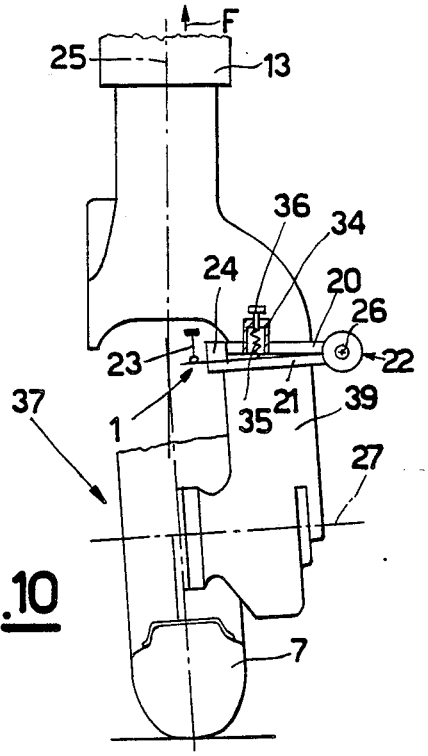
FIG. 10 shows a schematic view of the rear axle of FIG. 9, wherein the overturning-preventing device is in the condition of interruption of the lifting operation.
Figure 11:
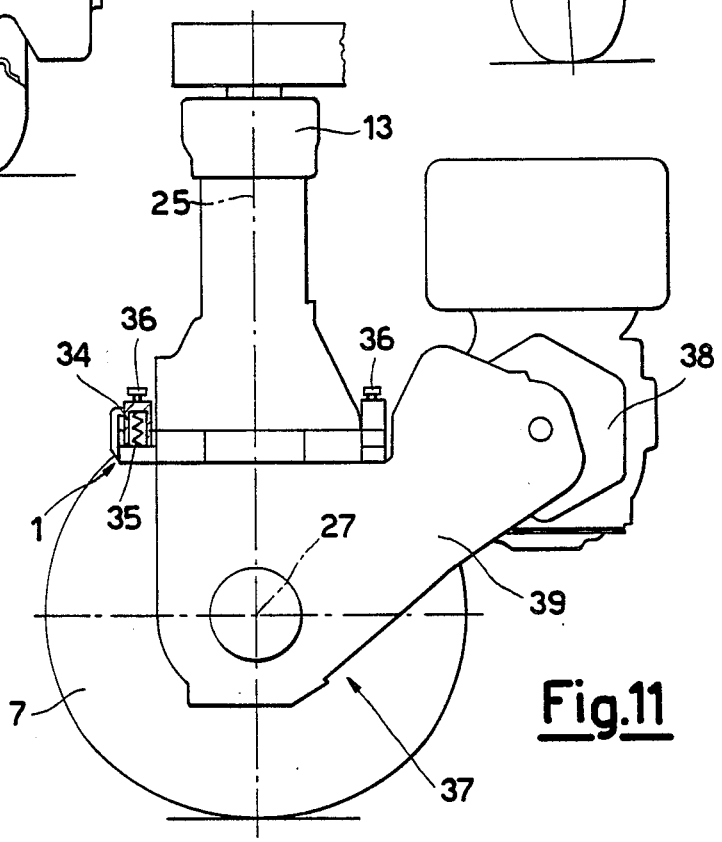
FIG. 11 shows a schematic side view of the rear axle of FIGS. 9 and 10.

The overturning-preventing device 1 can be also used on single-wheel-axle crane trucks, whether of light, or of heavy type, as shown in FIGS. 6 through 11.

For the sake of simplicity, in said FIGS. 6 through 11, the elements equal to such elements as illustrated in the preceding FIGS. 1 through 5 are marked by the same reference numerals.

The single-wheel axle 37, whether of light or of heavy type, is conventionally associated with a drive unit comprising a motor means 38 and a transmission 39 acting on the simgle rear wheel 7. The overturning-preventing device (1) can be finally also applied to lift trucks, in this case too the risk being avoided that said lift trucks may overturn owing to wrong lifting operations.

I claim:

1. Overturning-preventing device (1) for crane trucks (3) and similar machines, formed by a self-propelled truck (6) supporting operating means, with said truck (6) comprising a rear axle (2), the wheels (7) of which are linked to each other by means of a wheel axle (8) constrained to the truck (6) by means of vertical elements (10), characterized in that it is interposed between said vertical elements (10) of the rear axle (2) and the truck (6), and comprises: first plate means (20) integral with the vertical elements (10), second plate means (21) integral with the truck (6), a hinge (22) constraining, relatively to its own axis (26), said first plate means (20) and said second plate means (21), with said first plate means and said second plate means enabling, as the above mentioned rotation occurs, means (23) for discontinuing the operation of the crane (4).

2. Device according to claim 1, characterized in that the wheels 7 are driving and steering wheels, and the rotation axis (26) of the hinge (22) is always perpendicular to the axis (27) of revolution of the driving wheels (7).

3. Device according to claim 2, characterized in that the relative rotation of said first plate means (20) and said second plate means (21) is stopped at stroke end by a limit bridge (24).

4. Device according to claim 1, characterized in that it is associated to means (28A, 28B) for regulating the minimum load transitted by the axle (8) to the ground.

5. Device according to claim 4, characterized in that the means for adjusting the load transmitted by the axle to the ground are formed by a lever system (28A) comprising a power (33), a fulcrum (29) and a resistance (32).

6. Device according to claim 5, characterized in that said lever system (28A) is of third class, with the fulcrum (29) being provided on either one of the vertical elements (10), the power being transmitted to the lever by a flange (33) linked to the first plate means (20), the resistance being constituted by adjustable-intensity elastic means (32).

7. Device according to claim 6, characterized in that the power is transmitted by the flange (33) to the lever (31) of the system (28A) in a point, the distance of which from the fulcrum (29) is shorter than the distance of said point from the resistance (32).

8. Device according to claim 4, characterized in that the means (28B) for adjusting the minimum load transmitted to the ground comprise compression-operating elastic means (35) directly interposed between the first plate means (20) and the second plate means (21).

9. Device according to claim 8, characterized in that said elastic means are constituted by a pre-loaded spring (35) positioned in the nearby of those edges of the plate means (20, 21), which are opposite to the edges of said plate means which are associated with the hinge (22).

10. Device according to claim 9, characterized in that the pre-load of said spring (35) can be adjusted by means of screw means (36).

11. Device according to claim 1, characterized in that it can be applied to a single-wheel axle (37).

12. Device according to claim 11 and characterized in that it is associated with the single wheel axle (37) together with means (28A, 28B) for regulating the minimum load transmitted by the axle to the ground.

13. Device according to claims 1 characterized in that it is applied to lift trucks.

* * * * *